United States Patent [19]

Mori et al.

[11] Patent Number: 5,056,341

[45] Date of Patent: Oct. 15, 1991

[54] WASHING MACHINE

[75] Inventors: Koichi Mori; Tomonari Kawaguchi, both of Otsu, Japan

[73] Assignee: Sanyo Electric Co., Ltd., Osaka, Japan

[21] Appl. No.: 512,790

[22] Filed: Apr. 20, 1990

[30] Foreign Application Priority Data

Jun. 8, 1989 [JP] Japan ..... 1-145794
Oct. 5, 1989 [JP] Japan ..... 1-260762

[51] Int. Cl.[5] ..... B65D 85/68; D06F 37/24

[52] U.S. Cl. ..... 68/3 R; 206/320; 220/345; 220/625; 248/634; 248/638

[58] Field of Search ..... 68/3 R, 212; 220/345, 220/625, 626, 627; 206/320; 248/633, 634, 638

[56] References Cited

U.S. PATENT DOCUMENTS 3,912,207 10/1975 Gauer ..... 248/638 X

FOREIGN PATENT DOCUMENTS 2380960 10/1978 France ..... 206/320
0133193 11/1978 Japan ..... 206/320
57-37495 3/1982 Japan .
3197496 8/1988 Japan ..... 68/3 R
1-310696 12/1989 Japan .
721093 12/1954 United Kingdom ..... 68/3 R

*Primary Examiner*—Philip R. Coe
*Attorney, Agent, or Firm*—Darby & Darby

[57] ABSTRACT

A washing machine includes a washing tub elastically supported in a body of the washing machine; a sound insulation member covering the bottom surface of the body; the sound insulation member being formed with an opening for inserting packing to prevent the washing tub from moving when the washing machine should be packed; and a lid for opening and closing the opening.

9 Claims, 5 Drawing Sheets

11
13
12
10
4
5
7
1
2
8
6
9
3
21
15
15
20
19
20
16
14
3a
16
17
29

WASHING MACHINE

BACKGROUND OF THE INVENTION (i) Field of the Invention

The present invention relates to a washing machine, and more particularly, it relates to a washing machine having a washing tub elastically supported in its body.

(ii) Description of the Prior Art

A conventional washing machine of this type comprises, for example, an outer tub elastically suspended in its body, a washing and hydroextracting tub rotatably supported in the outer tub, an agitator placed at the bottom of the washing and hydroextracting tub and a motor mounted on the outer bottom of the outer tub, for rotating the agitator in a washing operation and rotating the washing and hydroextracting tub at a high speed in a hydroextracting operation. Unexamined Japanese Patent Publication No. 290985/1986 (DO6F37/26) discloses this type of full automatic washing machine in which a ventilation hole is formed at the bottom of a machine body almost tightly closed, and the ventilation hole is closed during a hydroextracting operation to prevent the noise from leaking without exerting adverse effects on cooling a motor.

This type of washing machine, when it is transported, must have its outer tub fixed by packing to prevent the outer tub from moving. In the conventional washing machine, however, there is no opening in the bottom portion of the body, and hence packing can not be inserted into the body.

The present invention relates to the improvement of washing machine and overcomes the above-mentioned disadvantage of the conventional washing machine.

SUMMARY OF THE INVENTION

The present invention provides a washing machine including a washing tub elastically supported in a body of the washing machine; a sound insulation member covering the bottom surface of the body and capable of blocking sound; the sound insulation member being formed with an opening for inserting packing to prevent the washing tub from moving when the washing machine should be packed; and a lid for opening and closing the opening.

Thus, in accordance with the present invention, the bottom face of the body is covered with the sound insulation member capable of preventing the noise from leaking out of the body, and the sound insulation member is formed with a specific opening which can be opened and closed by the lid. When the washing machine should be packed, the opening is kept open to insert packing into the body through the opening, whereby the washing tub is prevented from moving while transported.

DETAILED DESCRIPTION OF THE PREFERRED EMBODIMENTS

Figure 1:
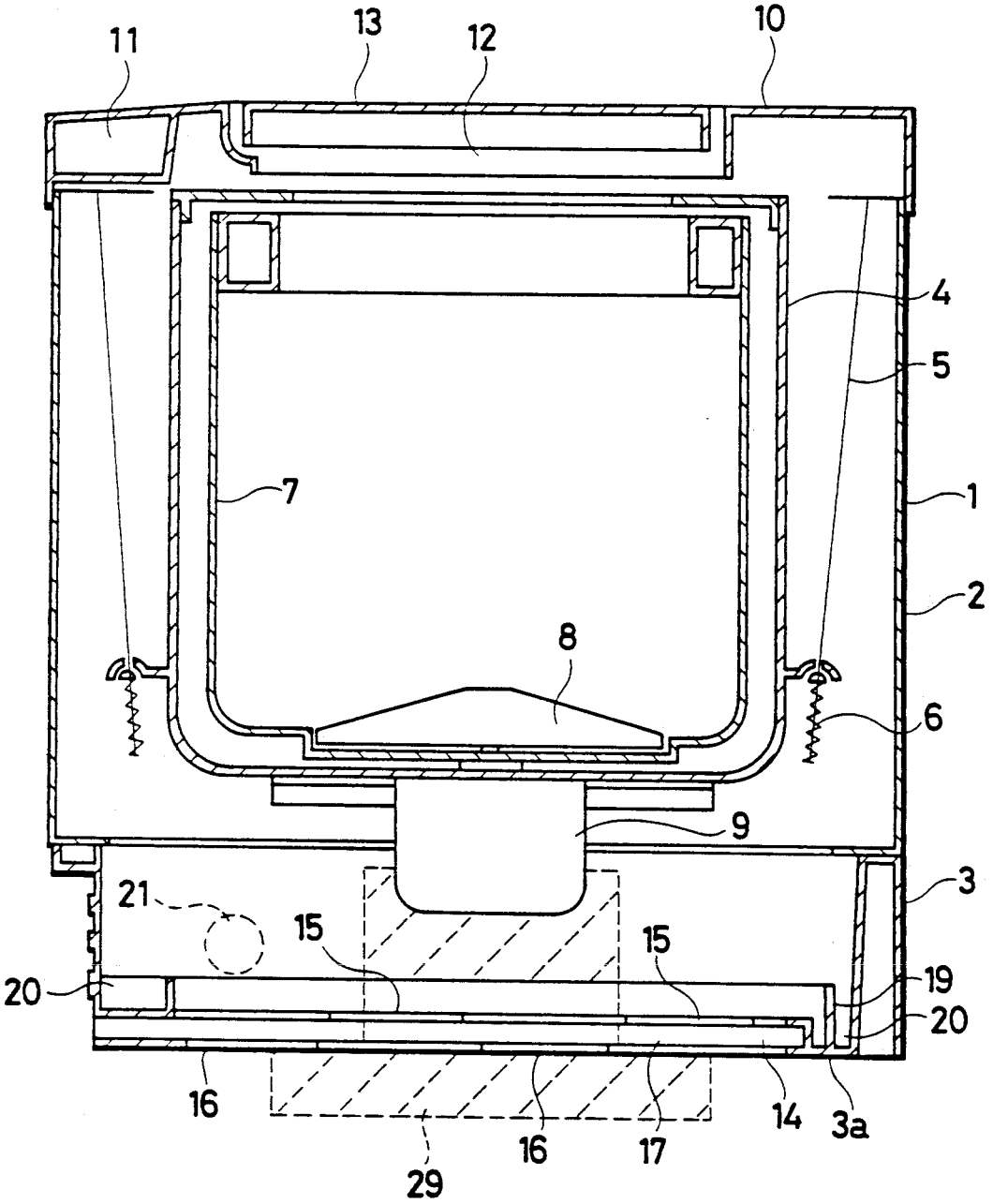
FIG. 1 is a sectional view showing a major portion of an embodiment of a washing machine according to the present invention.
Figure 2:
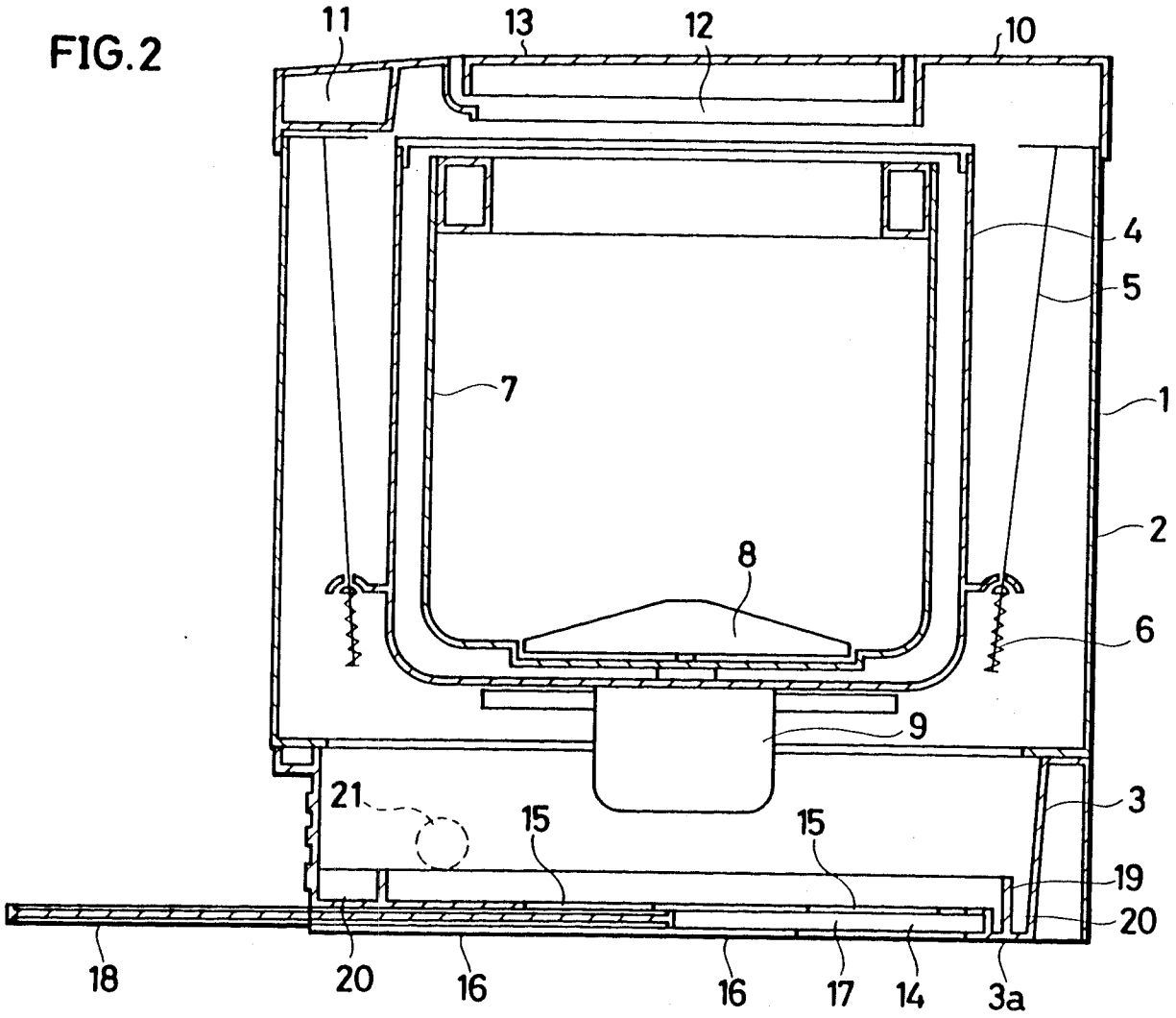
FIG. 2 is a sectional view corresponding to FIG. 1 and showing a noise insulation plate being inserted.
Figure 3:
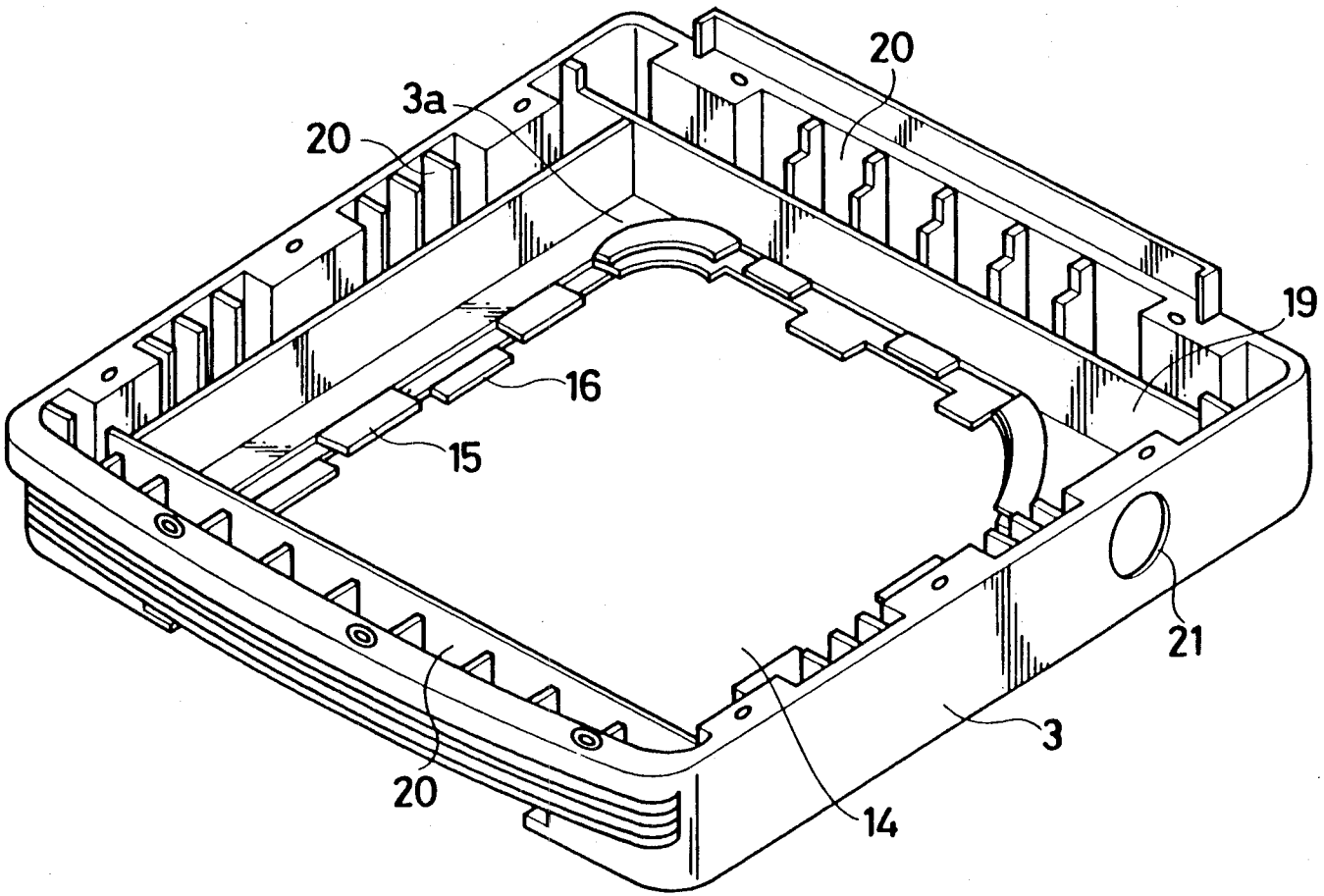
FIG. 3 is a perspective view showing a base made of resin.
Figure 5A:
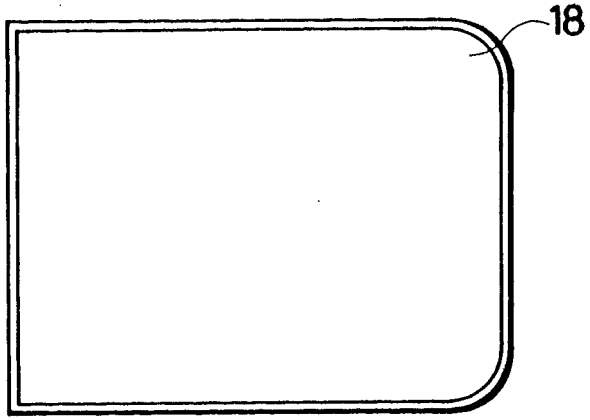
FIG. 5(A) is a plan view showing the noise insulation plate.
Figure 5B:
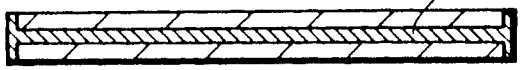
FIG. 5(B) is a sectional view showing the noise insulation plate.
Figure 4:
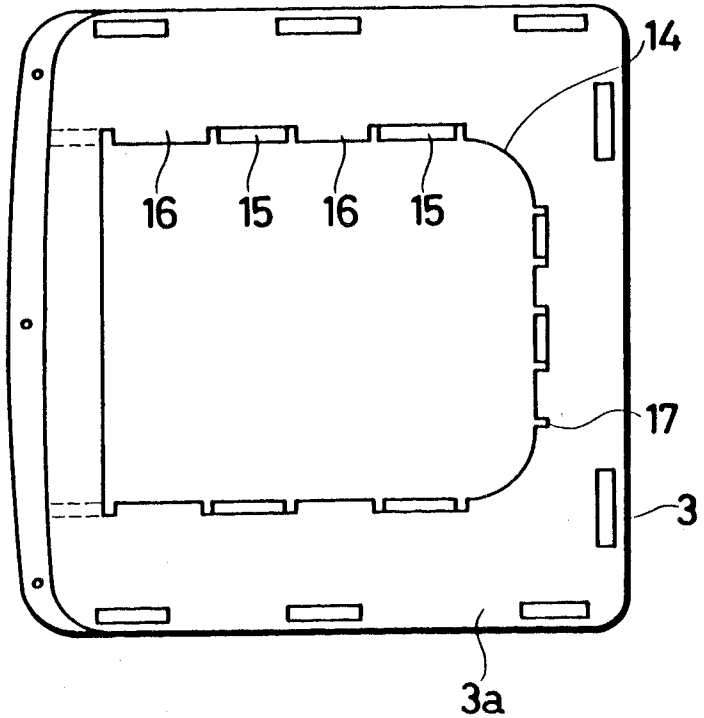
FIG. 4 is a bottom view showing the base of FIG. 3.

Embodiments according to the present invention will now be described in conjunction with the accompanying drawings.

In FIGS. 1 to 5, a full automatic washing machine includes a body 1 which is composed of a box-shaped cabinet 2 made of sheet metal and a base 3 made of a polypropylene resin and supporting the lower portion of the cabinet 2. In the machine body 1, an outer tub 4 is suspended by a rod 5 and a vibration insulator 6, and in the outer tub 4, a hydroextracting tub 7 which also serves as a washing tub is rotatably supported. An agitator 8 is placed at the bottom of the hydroextracting tub 7, and a motor 9 is placed at the outer bottom of the outer tub 4 to rotate the agitator 8 in a washing operation and the hydroextracting tub 7 in one direction at high speed in a hydroextracting operation.

A top plate 10 of synthetic resin is placed on the upper portion of the machine boby 1, and the top plate 10 is provided with a control box 11 in its front end and is formed with an opening 12 in the center portion for inserting and removing clothes. A lid 13 is provided for opening and closing the opening 12.

The base 3 is shaped like a box without a top side and is formed with a U-shaped opening 14 in the center of its bottom wall 3*a*. Supporting panels 15, 16 extend inward alternately from upper and lower portions along the edge of the wall 3*a* surrounding the opening 14, and thus a guide rail 17 is formed along the opposite sides and the rear portion of the opening 14. A noise insulation plate 18 serving as a lid is shaped almost corresponding to the opening 14 and is made of polypropylene resin having high specific gravity of 1.35 and including calcium carbonate as filler. The noise insulation plate 18 is inserted into the body 1 through the opening 14 along the guide rail 17 from the front of the body 1, and with a thickness almost the same as that of the guide rail 17, the noise insulation plate 18, when inserted, has its peripheral edge pressed against the inner face of the guide rail 17 to tightly close the opening 14. An annular wall 19 is provided along the periphery of the opening 14, and the wall 19 and an inner wall of the resin base 3 together define grooves 20 surrounding the opening 14. A drain hose connection 21 is provided lower than electric parts such as the motor 9.

While the washing machine is working, the noise insulation plate 18 closes the opening 14 to prevent sound caused by the motor 9 or the hydroextraction operation from leaking. When the washing machine should be packed, the noise insulation plate 18 is removed and a shock absorber 29 for packing is inserted into the body 1 through the opening 14 so as to fix the outer tub 4 by the shock absorber 29.

With the grooves provided surrounding the opening 14, dew drops on the outer peripheral surface of the outer tub 4 stand therein not to leak out of the washing machine through the opening 14.

It should be particularly noted that as stated above, a resin of high specific gravity is used as the material of the noise insulation plate 18, so that the noise insulation plate 18 increases in weight and rigidity and comes not to wobble easily. Thus, there is very few possibility that the noise insulation plate 18 makes a wobbling sound or the sound caused by the working machine leaks from the gap between the noise insulation plate 18 and the resin base 3. Empirically, with the noise insulation plate 18 of this embodiment, the noise can be reduced by about 2 dB (decibel), compared with a plate made of a polypropylene resin having a specific gravity of 0.9.

Figure 6:
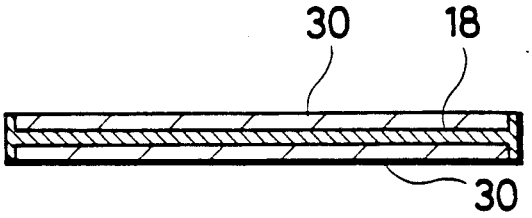
FIGS. 6 to 10 are views corresponding to FIG. 5(B) and showing different embodiments.

FIG. 6 shows the noise insulation plate 18 having sound absorbing members 30 of foam urethane resin affixed over the entire surface of its upper and lower sides, and the foam urethane sound absorbing members 30 can absorb sound and reduce the noise further by 1 dB, compared with the aforementioned case. Especially with such sound absorbing members, the noise belonging to high frequency band is absorbed, and although empirically the noise is reduced by 1 dB, actually the noise is felt to be considerably reduced.

Then, different manners of the noise insulation plate 18 including a sound absorbing member will be described.

Figure 7:
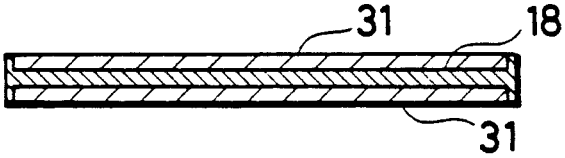

FIG. 7 shows the noise insulation plate 18 having sound absorbing members 31 made of preformed felt instead of the sound absorbing members 30 made of foam urethane resin.

Figure 8:
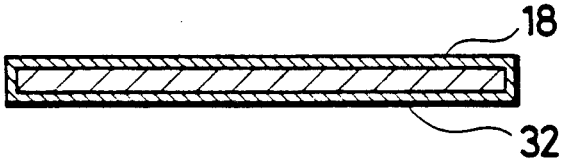

FIG. 8 shows the noise insulation plate 18 to which felt 32 is inserted when it is formed.

Figure 9:
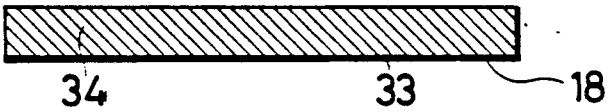

FIG. 9 shows the noise insulation plate 18 consisting of a foam layer 34 produced by foaming with expansion ratio of 1.3 and a resin layer 33 of a non-foam thin film remaining on the entire surface of the foam layer 34. The foam layer 34 is useful for sound absorption.

Figure 10:
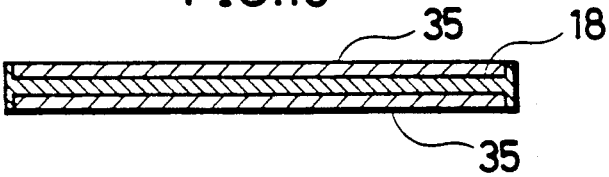

FIG. 10 shows the noise insulation plate 18 to which elastic plates 35 made by kneading asphalt and composite rubber, instead of the sound absorbing members 30 made of foam urethane resin. The elastic plates 35 increases in weight and rigidity.

In the aforementioned washing machine, the sound caused by the working machine is effectively blocked, and there is no problem in holding a washing tub when it is packed because a sound insulation member can be removed as required. A lid can be opened and closes from the front side of the machine, so that the lid can be opened and closed even after the washing machine is set in position. The lid does not easily wobble, and therefore the sound caused by the working machine can be further effectively blocked. The sound is blocked very well because of sound absorption function of the sound insulation member.

What is claimed is:

1. A washing machine comprising:

a washing tub;

a body in which said washing tub is resiliently supported;

sound insulation means for supporting said body and for preventing the noise generated during operation of said washing machine from leaking out of said body, said sound insulation means comprising:

a base for supporting said body and having a first opening for receiving a packing that prevents said washing tub from moving when said washing machine should be packed, and a second opening on a side of said base; and a removable sound absorbing element made of a synthetic resin having a high specific gravity and including a filler for increasing the specific gravity thereof insertable through said second opening for closing said first opening, said sound absorbing element being removable for opening the first opening to enable installation of the packing.

2. A washing machine according to claim 1, wherein said synthetic resin is polypropylene resin including calcium carbonate as the filler.

3. A washing machine according to claim 1 wherein said sound absorbing element has opposite major faces, and includes a sound absorbing member on an opposite major face remote from said washing tub.

4. A washing machine according to claim 3 wherein said sound absorbing member comprises a plate made of a foam urethane resin and affixed to a face of said sound absorbing element.

5. A washing machine according to claim 3 wherein said sound absorbing member is made of a preformed felt affixed to a face of said sound absorbing element,

6. A washing machine according to claim 3 wherein said sound absorbing member comprises an elastic plate of kneaded asphalt and composite rubber affixed to a face of said sound absorbing element.

7. A washing machine according to claim 1 wherein said sound absorbing element comprises a plate made of a synthetic resin which is surrounded by felt.

8. A washing machine according to claim 1 wherein said sound absorbing element comprises a synthetic resin plate having a thin non-foam resin layer over an entire surface thereof.

9. A washing machine according to claim 1 wherein said washing tub comprises an outer tub elastically suspended in said body, a washing and water extracting tub rotatably supported in said outer tub, an agitator at a bottom of said washing and water extracting tub, and a motor mounted to a bottom of said outer tub for rotating said agitator during a washing operation and rotating said washing and water extracting tub at high speed during a water extracting operation.

* * * * *